US008322889B2

(12) United States Patent
Petroski

(10) Patent No.: US 8,322,889 B2
(45) Date of Patent: Dec. 4, 2012

(54) PIEZOFAN AND HEAT SINK SYSTEM FOR ENHANCED HEAT TRANSFER

(75) Inventor: James T. Petroski, Parma, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 1286 days.

(21) Appl. No.: 11/531,170

(22) Filed: Sep. 12, 2006

(65) Prior Publication Data

US 2008/0062644 A1 Mar. 13, 2008

(51) Int. Cl.
*F21V 29/00* (2006.01)
*H05K 7/20* (2006.01)
*F04B 19/00* (2006.01)

(52) U.S. Cl. ..... 362/294; 361/694; 417/410.2

(58) Field of Classification Search ..... 417/410.2, 417/436, 413.2; 361/679.48–679.51, 694–697; 165/122; 362/294, 373; 257/E23.099, E23.102
See application file for complete search history.

(56) References Cited

U.S. PATENT DOCUMENTS

| | | | | |
|---|---|---|---|---|
| 3,464,672 | A | 9/1969 | Massa | |
| 4,063,826 | A * | 12/1977 | Riepe | 417/410.1 |
| 4,406,323 | A | 9/1983 | Edelman | |
| 4,490,649 | A | 12/1984 | Wang | |
| 4,498,851 | A | 2/1985 | Kolm | |
| 4,501,319 | A | 2/1985 | Edelman et al. | |
| 4,503,358 | A | 3/1985 | Kamel et al. | |
| 4,590,399 | A | 5/1986 | Roxlo et al. | |
| 4,595,338 | A | 6/1986 | Kolm et al. | |
| 4,630,182 | A | 12/1986 | Moroi et al. | |
| 4,667,877 | A | 5/1987 | Yao et al. | |
| 4,763,225 | A | 8/1988 | Frenkel et al. | |
| 4,780,062 | A | 10/1988 | Yamada et al. | |
| 4,923,000 | A * | 5/1990 | Nelson | 165/122 |

(Continued)

FOREIGN PATENT DOCUMENTS

EP 0 385 090 A1 9/1990

(Continued)

OTHER PUBLICATIONS

Sudipta Basak, Arvind Raman and Suresh V. Garimella; *Dynamic Response Optimization of Asymmetrically Configured Piezoelectric Fans*; Proceedings of DETC'03, ASME 2003 Design Engineering Technical Conferences and Computers and Information in Engineering Conference, Sep. 2-6, 2003, Chicago, Illinois, USA.

(Continued)

*Primary Examiner* — Peter J Bertheaud
(74) *Attorney, Agent, or Firm* — Fay Sharpe LLP

(57) ABSTRACT

An electronic device having enhanced heat dissipation capabilities includes an electronic device, a heat sink, a channel, a piezoelectric element, and a blade. The heat sink is in thermal communication with the electronic device. The channel includes an inlet, an outlet and a constriction disposed along the channel between the inlet and the outlet. The heat sink defines at least a portion of the channel. The blade includes a free end and an attached end. The blade is disposed in the channel and connected to the piezoelectric element. The piezoelectric element is activated to move the blade side to side in the channel to create air vortices. The constriction in the channel and the blade cooperate with one another such that a vortex that is generated as the blade moves toward a first side of the channel is compressed against the first side of the channel and expelled towards the outlet of the channel.

6 Claims, 5 Drawing Sheets

U.S. PATENT DOCUMENTS

| | | | | |
|---|---|---|---|---|
| 4,941,398 | A | 7/1990 | Morris et al. | |
| 5,008,582 | A * | 4/1991 | Tanuma et al. | 417/410.2 |
| 5,089,862 | A | 2/1992 | Warner, Jr. et al. | |
| 5,130,912 | A | 7/1992 | Friederichs et al. | |
| 5,136,489 | A | 8/1992 | Cheng et al. | |
| 5,278,432 | A | 1/1994 | Ignatius et al. | |
| 5,335,143 | A | 8/1994 | Maling et al. | |
| 5,419,780 | A | 5/1995 | Suski | |
| 5,522,712 | A * | 6/1996 | Winn | 417/410.2 |
| 5,758,823 | A | 6/1998 | Glezer et al. | |
| 5,785,418 | A | 7/1998 | Hochstein | |
| 5,861,703 | A * | 1/1999 | Losinski | 257/E23.099 |
| 5,921,757 | A | 7/1999 | Tsutsui et al. | |
| 5,941,694 | A | 8/1999 | Tsutsui | |
| 6,008,126 | A | 12/1999 | Leedy | |
| 6,020,257 | A | 2/2000 | Leedy | |
| 6,045,240 | A | 4/2000 | Hochstein | |
| 6,123,145 | A | 9/2000 | Glezer et al. | |
| 6,252,726 | B1 | 6/2001 | Verdiell | |
| 6,318,886 | B1 | 11/2001 | Stopa et al. | |
| 6,333,852 | B1 | 12/2001 | Lin | |
| 6,357,893 | B1 | 3/2002 | Belliveau | |
| 6,440,212 | B1 | 8/2002 | Hayes | |
| 6,451,175 | B1 | 9/2002 | Lal | |
| 6,457,654 | B1 | 10/2002 | Glezer et al. | |
| 6,481,874 | B2 | 11/2002 | Petroski | |
| 6,511,209 | B1 | 1/2003 | Chiang | |
| 6,517,221 | B1 | 2/2003 | Xie | |
| 6,541,800 | B2 | 4/2003 | Barnett et al. | |
| 6,554,607 | B1 | 4/2003 | Glezer et al. | |
| 6,588,497 | B1 | 7/2003 | Glezer et al. | |
| 6,770,960 | B2 | 8/2004 | Oohata | |
| 6,815,724 | B2 | 11/2004 | Dry | |
| 7,204,615 | B2 * | 4/2007 | Arik et al. | 362/294 |
| 2001/0030866 | A1 | 10/2001 | Hochstein | |
| 2003/0075615 | A1 | 4/2003 | Saddoughi | |
| 2003/0177899 | A1 | 9/2003 | Monson et al. | |
| 2004/0120148 | A1 | 6/2004 | Morris et al. | |
| 2004/0190305 | A1 | 9/2004 | Arik et al. | |

FOREIGN PATENT DOCUMENTS

| | | |
|---|---|---|
| FR | 1 218 663 | 5/1960 |
| JP | 62072149 | 4/1987 |
| WO | WO 98/54765 | 12/1998 |

OTHER PUBLICATIONS

Tolga Açikalin, Brian D. Iverson, Suresh V. Garimella and Arvind Rama, *Numerical Investigation of the Flow and Heat Transfer Due to a Miniature Piezoelectric Fan*, Proceedings of IMECE04, 2004 ASME International Mechanical Engineering Congress and Exposition, Nov. 13-20, 2004, Anaheim, California, USA.

Tolga Açikalin, Suresh V. Garimella, James Petroski, and Arvind Rama; *Optimal Design of Miniature Piezoelectric Fans for Cooling Light Emitting Diodes*; 2004 Inter Society Conference on Thermal Phenomena; pp. 663-671.

Philipp Bürmann, Arvind Rama and Suresh V. Garimella; *Dynamics and Topology Optimization of Piezoelectric Fans*; IEEE Transactions on Components and Packaging Technologies, vol. 25, No. 4, Dec. 2003.

Jelena Vukasinovic and Ari Glezer, *Spot-Cooling by Confined, Impinging Synthetic Jet*, Proceedings of HT2003, ASME Summer Heat Transfer Conference, Jul. 21-23, 2003, Las Vegas, Neveda, USA.

Emil Venere, *Engineers create tiny, wiggling fans to cool future electronics*, Purdue News at http://news.uns. purdue.edu/UNS/html4ever/011213.Garimella.fans.html, Dec. 6, 2002.

* cited by examiner

PIEZOFAN AND HEAT SINK SYSTEM FOR ENHANCED HEAT TRANSFER

BACKGROUND

Piezoelectric fans operate as a vortex shedding device. U.S. Pat. No. 4,498,851 nicely describes vortex shedding as a process where air is prevented from being sucked around a piezoelectric fan blade tip when its motion reverses. Vortex shedding is based on the fact that air displaced from the front of a moving blade rotates so rapidly that the air is unable to reverse its direction of rotation when the blade reverses its motion. If the rotation is not sufficiently rapid, the vortex can reverse its direction of rotation to be sucked around the blade tip instead of leaving the blade.

The vortex shedding action is illustrated in FIGS. 1A-1I. In FIG. 1A, a blade 10 of a piezoelectric fan is centered and moving upward at maximum velocity as indicated by arrow 12, and air is being sucked downward around the blade tip as indicated by arrow 14. While this is happening, a previously shed vortex 16 is moving to the right below a center line 18 of the blade (the center line being when the blade 10 is at rest). In FIG. 1B, the blade 10 is beginning to curve upward at about one quarter amplitude. The air is being sucked around the blade tip into a vacuum on the back (lower per the orientation in FIG. 1B) side of blade 10 and the new vortex 14*a* is beginning to form while the old vortex 16 is moving farther to the right. The blade 10 nears an upper (per the orientation in FIG. 1C) end of its travel in FIG. 1C, leaving a fully formed vortex 14*b* in its wake, with vortex 16 still moving outwardly.

In FIG. 1D, blade 10 has reached its full upward excursion and it has stopped moving and is about to reverse with the fully formed vortex 14*b* still in its wake and the previously formed vortex 16 still moving to the right. The blade 10 then starts downwardly again in FIG. 1E. The vortex 14*b* is rotating too rapidly to reverse this motion and it is therefore expelled from the blade area by the new airflow around the blade 10. The new airflow 20 is moving up around the tip of the blade 10 towards its wake, while the blade is moving in the direction as shown by arrow 22. Upward flow 20 continues to gain speed as air flows into the vacuum behind (upper per the orientation in FIG. 1F) the blade and the previous vortex 14*b* is now clear of the blade wake and gaining speed. The blade 10 accelerates towards its center position in FIG. 1G while the air flowing into its wake indicated by arrow 20 is developing a new vortex. In FIG. 1H, with the blade 10 centered and moving downward at maximum velocity as indicated by arrow 22, the air being drawn into the vacuum of the wake has developed into a full vortex 20*b*. Finally, in FIG. 1I the blade 10 is moved further downward, feeding more air into vortex 20*b* in its wake. The two previous vortices 14*b* and 16 are moved toward the right, rotating in opposite directions, one above the center line 18 the other below the center line 18 of blade 10. In this way, a line of oppositely rotating vortices is generated resulting in a highly directional stream of air.

U.S. Pat. No. 4,498,851 indicates that if the vortex shedding effect is disturbed by obstructions in the area, then the air flows from the forward surface of the blade around its trailing edge to the rearward surface of the blade when the motion of the blade reverses. Accordingly, there is only circulation around the trailing edge of the blade and very little outward flow.

In some instances it is, however, it is desirable to provide ducts or channels, i.e. obstructions according to U.S. Pat. No. 4,498,851, to direct the air flow. This may be desirable when certain components are to be cooled by the piezoelectric fan.

U.S. Pat. No. 4,498,851 does not provide any teaching for directing air flow generated by a piezoelectric fan where ducts and channels are desired.

BRIEF DESCRIPTION

An assembly having enhanced heat dissipation capabilities includes an electronic device, a heat sink, a channel, a fan blade, a piezoelectric element, and a constrictive member. The heat sink is in thermal communication with the electronic device. The heat sink defines a base surface. The base surface of the heat sink at least partially defines the channel. The fan blade is disposed in the channel. The blade is spaced from the base surface of the heat sink and disposed generally perpendicular to the base surface. The blade includes first and second planar surfaces. The piezoelectric element attaches to the blade. The piezoelectric element is activated to cause the blade to oscillate and generate an air flow path in the channel in which air travels generally in a direction from an attached end of the blade toward a free end of the blade. The constrictive member extends into the channel generally towards at least one of the planar surfaces of the blade between the free end and the attached end of the blade.

An electronic device having enhanced heat dissipation capabilities includes an LED device, a heat sink, a channel, a piezoelectric element, and a blade. The heat sink is in thermal communication with the LED device. The channel includes an inlet, an outlet and a constriction disposed along the channel between the inlet and the outlet. The heat sink defines at least a portion of the channel. The blade includes a free end and an attached end. The blade is disposed in the channel and connected to the piezoelectric element. The piezoelectric element is activated to move the blade side to side in the channel to create air vortices. The constriction in the channel and the blade cooperate with one another such that a vortex that is generated as the blade moves toward a first side of the channel is compressed against the first side of the channel and expelled towards the outlet of the channel.

A method for cooling an electronic device includes the following steps: placing a heat sink in thermal communication with an electronic device; oscillating a fan blade adjacent to the heat sink to generate an air vortex over the heat sink; and compressing the air vortex against a surface. The surface is configured to urge the vortex further downstream as the vortex is being compressed against the surface.

DETAILED DESCRIPTION

Figure 2A:
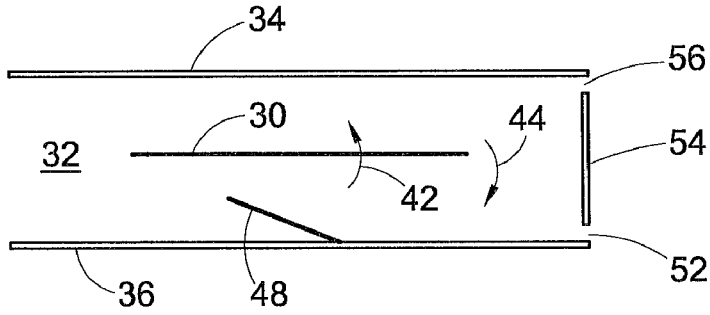
FIGS. 2A-2D are a series of schematic illustrations of the generation and shedding of vortices by a piezoelectric fan in a channel that shapes the vortices.
Figure 2B:
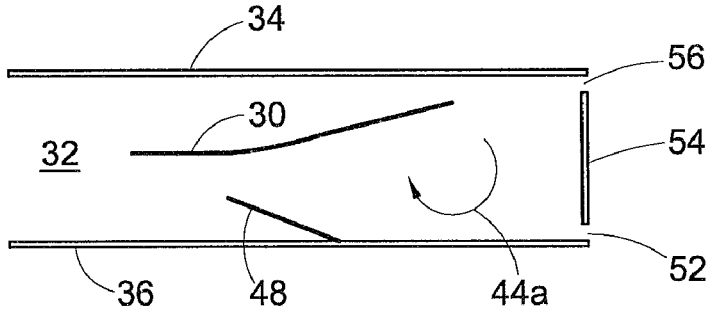
Figure 2C:
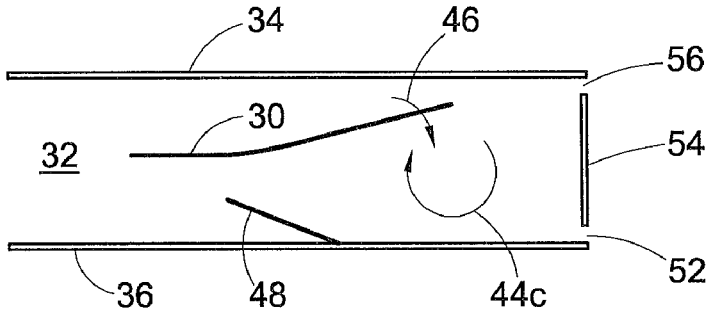
Figure 2D:
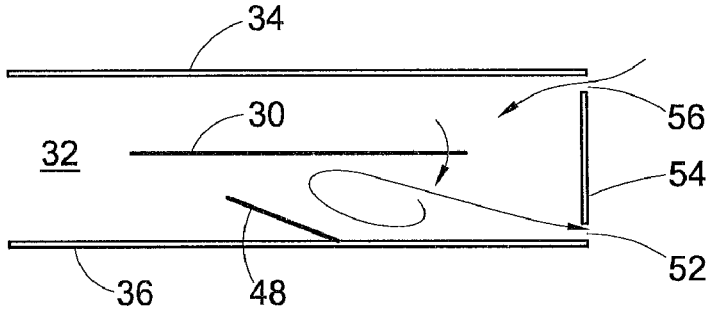

FIGS. 2A-2D depict a blade 30 of a piezoelectric fan disposed in a channel 32 defined by a first side wall 34, a second side wall 36 and a base wall (not numbered) that the side walls extend upwardly from. The blade is driven by a piezoelectric element (not shown), which will be described later. In FIG. 2A, the blade 30 of the piezoelectric fan is centered and moving upward as indicated by arrow 42, and air is being sucked toward the second wall 36 around the blade tip as indicated by arrow 44. The blade 30 nears its maximum stroke of its travel in FIG. 2B, leaving a nearly fully formed vortex 44*a* in its wake. The blade 30 then starts downwardly again in FIG. 2C as indicated by arrow 46. A fully formed vortex 44*c* is compressed against a constriction (formed by a constrictive member 48 extending into the channel 32 from the second side wall 36) and is expelled from an outlet 52 of the channel as seen in FIG. 2D as the blade 30 continues to move toward the second side wall 36. The constrictive member 48 is shown attached to the second side wall 36; however, the constrictive member can simply extend upwardly into the channel 32 from the base or the constrictive member may depend downwardly from a lid that at least partially covers the channel. An example of a lid will be described in more detail below.

In the embodiment depicted in FIGS. 2A-2D, one outlet 52 is defined between a baffle 54 and the second side wall 36. An additional outlet 56, which can operate as an inlet (the first mentioned outlet 52 can also operate as an inlet) is defined between the baffle 54 and the first side wall 34. The baffle can also depend downwardly from a lid that at least partially covers the channel. The vortex 44*a* is shaped in the channel 32 to increase the velocity of the air leaving the channel, which allows more heat to escape from the channel. The constriction reduces the cross-sectional area (Ac) of the channel at the constriction as compared to the cross-sectional area of the channel both upstream of and downstream from the constriction. The baffle 54 further limits the cross-sectional area of the channel where the baffle is located (Ao). Because of the conservation of momentum and that the air is not traveling quickly enough to be compressed, the velocity of the air moving through the outlet 52 is much quicker than if the baffle 54 were not present. Nevertheless, if desired the baffle 54 need not be present. The constriction in the channel 32 precludes the air vortex from moving further to the left (as per the orientation of FIGS. 2A-2D), thus avoiding the problem of recirculation with very little outward flow as discussed in U.S. Pat. No. 4,498,851.

Figure 3:
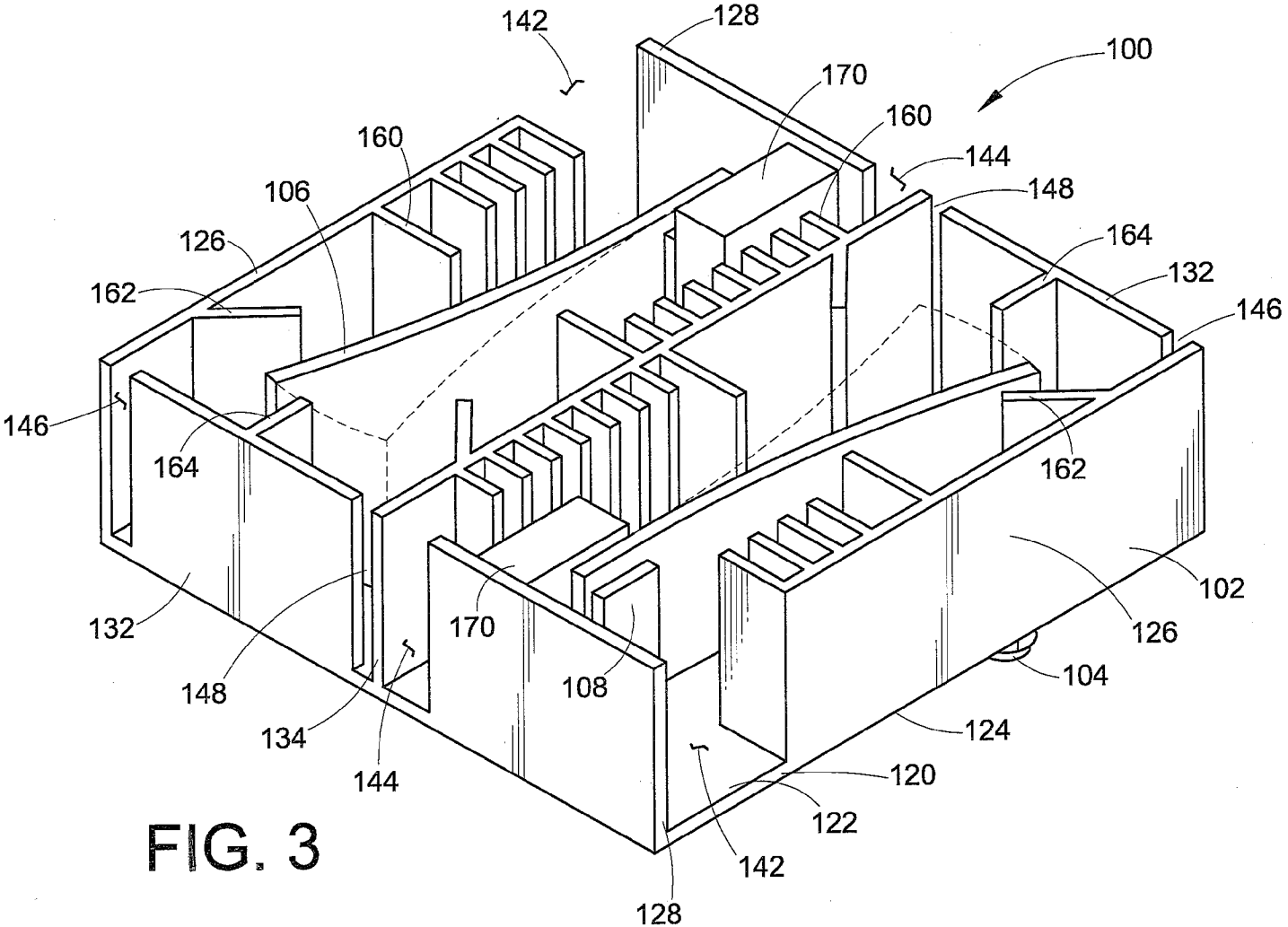
FIG. 3 is a perspective view of an electronic device having an enhanced heat dissipation system.

With reference to FIG. 3, a device 100 having enhanced heat transfer capabilities includes a heat sink 102, an electronic device 104 (or a plurality of electronic devices) in thermal communication with the heat sink, a pair of fan blades 106 connected to the heat sink, and a pair of piezoelectric elements 108 attached to a respective blade. The heat sink 102 includes a plurality of walls defining a pair of channels 112 (FIG. 4) through which air flows to transfer heat generated by the electronic devices 104. The components and configuration of each channel 112 depicted in FIG. 3 are the same except that one channel and the elements associated with it are rotated 90° with respect to the other. The blades 106 can oscillate 180° out of phase with each other such that the complementary back and forth motion of the two blades 106 provides balancing and prevents vibration of the device 100. The blades have a generally rectangular configuration having opposite planar surfaces.

The electronic devices 104 depicted in FIG. 3 are light emitting diode devices ("LEDs"). Other electronic devices that generate heat, in addition to or in lieu of LEDs, can also be attached to the heat sink 102. In the depicted embodiment, the heat sink 102 includes a base 120. The base 120 includes an upper planar surface 122 and a lower planar surface 124. Alternatively, the base 120 need not be planar. The LEDs 104 attach to the lower surface 124. A thermally conductive support, such as a metal core printed circuit board, can be interposed between the LEDs 104 and the lower planar surface 124. The circuit board, or other similar device, includes circuitry in electrical communication with a power source (not shown) to provide electricity to the LED or other electrical device.

Outer side walls 126 extend upwardly from the base 120. Inlet end walls 128 also extend upwardly from the base 120 adjacent to an attached end of the blade 106. Outlet end walls 132 extend upwardly from the base 120 adjacent to a free end of the blade 106. The inlet end walls 128 and the outlet end walls 132 are generally perpendicular to both the base 120 and the outer side walls 126. An inner wall 134 is positioned between each blade 106 and extends upwardly from the base 120. The inner wall 134 is disposed generally parallel to each of the outer side walls 126 and perpendicular to the base 120 and the end walls 128 and 132.

The base 120 and the walls 126, 128, 132, and 134 generally define the channels 112. For each channel 112, a first opening 142 is defined between the inlet end wall 128, the base 120 and the outer side wall 126. For each channel 112, a second opening 144 is defined between the internal wall 134, the base 120 and the inlet end wall 128. The first opening 142 and the second opening 144 generally act as inlets for the channel 112. For each channel, a third opening 146 is defined between the outer side wall 126, the base 120 and the outlet end wall 132. For each channel, a fourth opening 148 is defined generally between the central wall 134, the base 120 and the outlet end wall 132. The third opening 146 and the fourth opening 148 act generally as outlets for the channel 112. As described below, the third opening 146 and the fourth opening 148 can also act as inlets.

Figure 4:
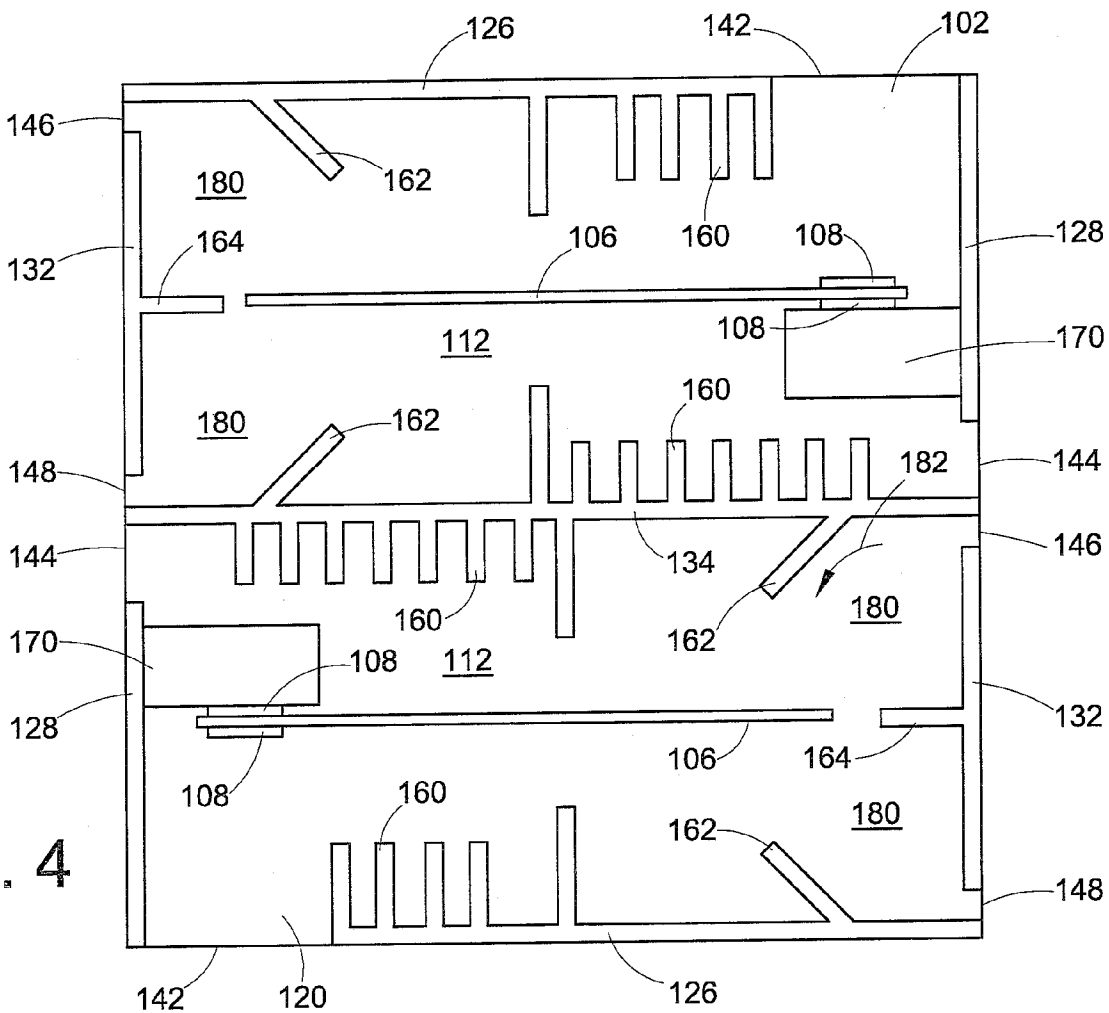
FIG. 4 is a top plan view of the device depicted in FIG. 3.

A plurality of fins 160 extend inwardly from the outer side walls 126 and the internal side wall 134. The fins 160 are disposed nearer to the attached end of the blade 106 than the free end of the blade. A pair of angled walls 162 also extends into the channel 112 to provide a constriction to limit the cross-sectional area of the channel 112 in the area of the constriction. For each channel 112, one of the angled walls 162 extends inwardly from the outer wall 126 and another extends inwardly from the internal wall 134. The angled walls 162 are disposed at an obtuse angle with respect to the upstream portion of the respective wall (either outer wall 126 or internal wall 134) to encourage vortices that contact the angled walls to be urged towards their respective outlets 146 and 148 as will be described in more detail below. In the depicted embodiment, a baffle 164 also extends inwardly from the outlet end wall 132. The baffle 164 extends in a plane that is generally coplanar with the blade 106 when the blade is at rest, as seen in FIG. 4.

The blade 106 attaches to a pedestal 170 that extends upwardly from the base 120. In the depicted embodiment, the pedestal 170 is disposed adjacent the inlet end wall 128; however, the pedestal 170 can be placed elsewhere. The blade 106 is made of a flexible material, preferably a flexible metal. An unattached or free end of the blade 106 cantilevers away from the pedestal 170 and over the upper surface 122 of the base 120. The blade 106 mounts to the pedestal 170 so that the blade does not contact the upper surface 122 of the base 120. If desired, the blade can attach to the pedestal at a central location along the blade such that the blade would have two free ends.

The piezoelectric material 108 attaches to the blade 106 opposite the free end (and in the depicted embodiment adjacent to pedestal 170). Alternatively, the piezoelectric material 108 can run the length or a portion of the length of the blade 106. The piezoelectric material 108 comprises a ceramic material that is electrically connected to the power source (not shown) in a conventional manner. As electricity is applied to the piezoelectric material 108 in a first direction, the piezoelectric material expands, causing the blade 106 to move in one direction. Electricity is then applied in the alternate direction, causing the piezoelectric material 108 to contract thus moving the blade 106 back in the opposite direction. Alternating current causes the blade 106 to move back and forth continuously in the channel 112. The blade 106 and the angled walls 162 are configured such that the blade does not contact the angled walls as it moves back and forth in the channel 112.

During operation of the device, the LEDs 104 (or other heat generating device) generate heat. The LED device 104 includes a die (not visible) that allows conduction of the heat generated by the LED to transfer into the heat sink 102. Meanwhile, an alternating current is supplied to the piezoelectric material 108 causing the blade 106 to move back and forth in the channel 112, which results in a fluid (typically air) current moving generally through the channel 112.

Figure 1:
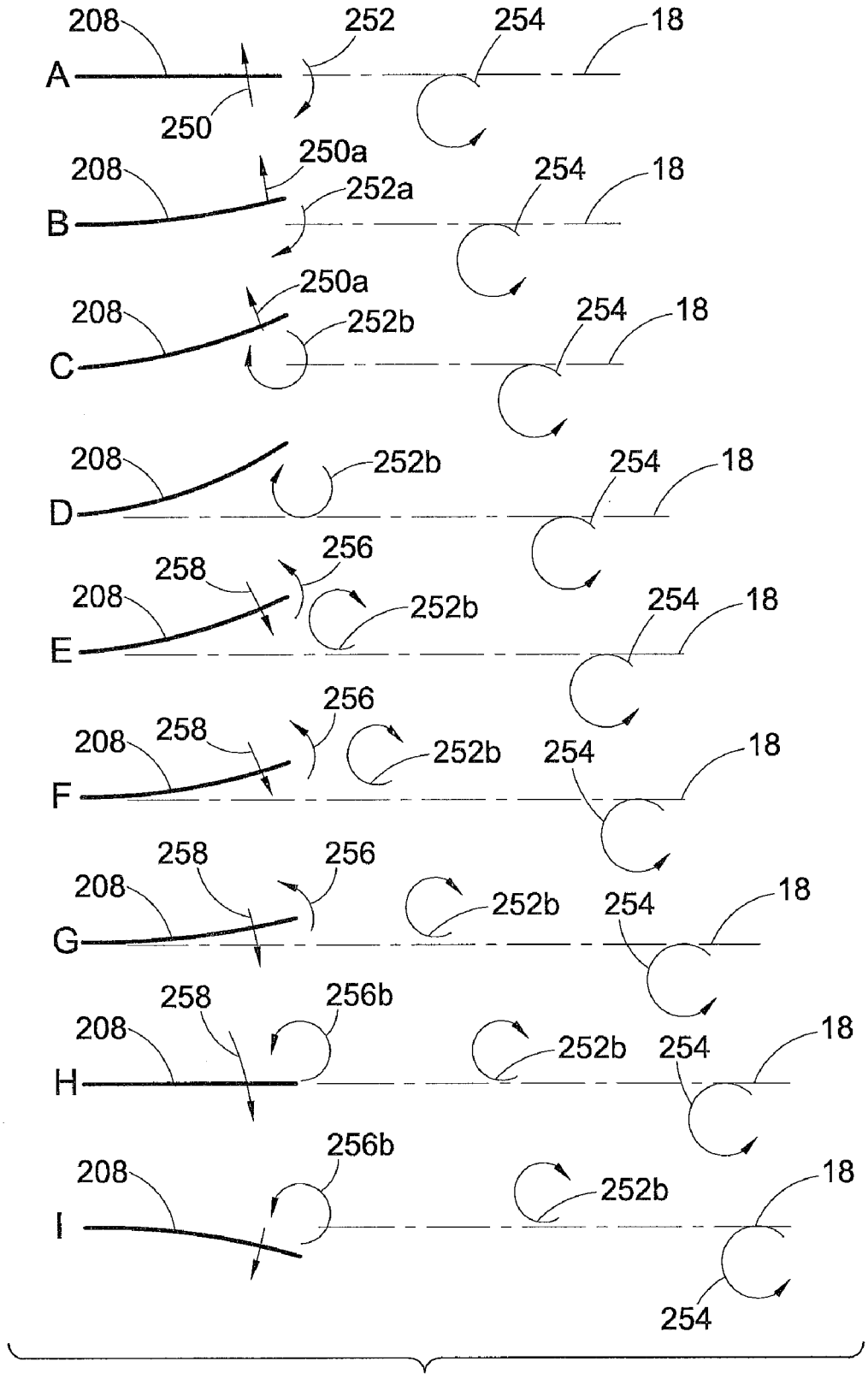
FIGS. 1A-1I are a series of schematic illustrations of the generation and shedding of vortices by a known piezoelectric fan.

With specific reference to FIG. 4, air generally enters into the channel 112 through the inlet openings 142 and 144 and moves through the channel and is finally expelled through the outlet openings 146 and 148. As per the orientation depicted in FIG. 4, air generally moves from right to left in the upper channel 112 and from left to right in the lower channel 112. Such a configuration allows for LEDs 104 (or other electronic devices) to be placed in any location on the lower surface 124 (FIG. 3) of the base 120 of the heat sink 102. The angled walls 162 extend into the channel 112 to provide a constriction in the channel. The area of the channel 112 upstream of the angled walls 162 can be referred to as a vortex shaping zone 180. As the blades 106 move back and forth in the channel 112, vortices are formed via the shedding action that is described with reference to FIGS. 1 and 2. The angled walls 162 inhibit airflow movement in a direction going from a free end of the blade 106 towards the attached end of the blade as depicted by arrow 182 (FIG. 4). The angled walls 162 act as a sort of nozzle that urges the vortex (as depicted by arrows 182) towards the respective outlets 146 and 148 thus expelling hot air from the channel 112. Because of the conservation of momentum, the smaller cross-sectional outlet openings 146 and 148, as compared to the portion of the channel just upstream from the outlets, results in high velocity flow through the outlet openings 146 and 148 thus expelling a greater amount of hot air from the channel 112 more quickly than if the outlet end walls 132 were not provided. As most clearly seen in FIG. 4, the distal ends (innermost ends) of the angled walls 162 are disposed between the free end of the blade 106 and the attached end thus encouraging the formation of the vortex shaping zone 180.

With reference to the upper channel 112 depicted in FIG. 4 (the lower channel 112 would act in much the same way) as the blade 106 moves toward the outer side wall 126, a vacuum is formed in the channel on a side of the blade 106 that generally faces the inner wall 134. This vacuum draws air from an area of the channel 112 adjacent the second inlet opening 144 and also through the second outlet opening 148, thus making the second outlet opening an additional inlet opening. Similarly, as the blade 106 moves towards the inner wall 134, a vacuum is formed on a side of the blade that generally faces the external wall 126. This vacuum draws air from an area of the channel 112 near the first inlet opening 142 and also draws air through the first outlet opening 146, thus making the first outlet opening an additional inlet.

The fins 160 are provided nearer to the attached end of the blade 106 as compared to the free end. The air velocity through the portion of the channel 112 where the fins 160 are located will be generally lower than the vortex shaping area 180 of the channel 112. Accordingly, additional heat can be dissipated from the LEDs 104 using the fins as additional heat dissipating members. Accordingly, the fins, as well as the walls 126, 128, 132, 162, and 164 can be made of a heat dissipating material to further increase the heat transfer from the LEDs 104 into the ambient, i.e., the area outside of the channel.

Figure 5:
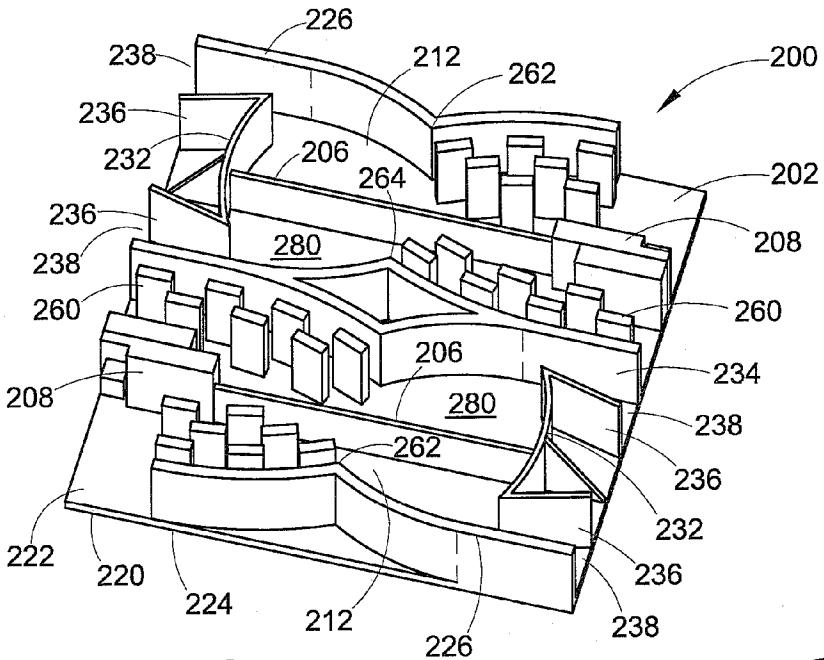
FIG. 5 is a perspective view of an alternative embodiment of an electronic device having an enhanced heat dissipating system.

With reference to FIG. 5, an alternative embodiment of a heat dissipating electronic device 200 is disclosed. The electronic device 200 includes a heat sink 202 that is similar to the heat sink 102 described above. Electronic devices (not visible, but similar to the electronic devices disclosed above) attach to the heat sink 202. A pair of blades 206 (similar to blades 106) also connect to the heat sink. Piezoelectric material 208 that is driven by an alternating current attaches to the blades 206 so that when current is applied to the piezoelectric material the blades oscillate within channels 212 disposed adjacent to (and in the depicted embodiment formed integrally with) the heat sink 202.

The heat sink 202 includes a base 220 having an upper surface 222 and a lower surface 224. The electronic device is attached to the lower surface 224. A pair of outer walls 226 extend upwardly from the upper surface 222 of the base 220. A curved upstream barrier wall 232 extends upwardly from the upper surface 222 of the base 220 and is disposed upstream from a free end of each blade 206. In the embodiment depicted in FIG. 5, the upstream barrier member 232 is generally curved following a radius of curvature that generally coincides with the radius of curvature that the free end of the blade 206 travels when oscillating back and forth in the channel 212. An interior wall member 234 extends upwardly from the upper surface 222 of the base 220 generally between each of the blades 206. Accordingly, the channel 212 is generally defined between one of the outer walls 226, the upper surface 222 of the base 220 and a respective side of the interior wall member 234.

Air generally travels through the channel 212 from an end of the channel adjacent the attached end of the blade 206 towards an end of the channel adjacent the free end of the blade. Each barrier member 232 includes wings 236 that extend in the same general direction (although not exactly parallel) as the outer wall 226 and the inner wall member 234 to form outlet openings 238 for the channel 212. The outlet openings 238 can also act as additional inlets similar to the openings 146 and 148 described above. The barrier member 232 restricts the cross-sectional area of the channel 212 adjacent the outlet openings 238 as compared to a portion of the channel that is located upstream from the outlet openings. As explained above, due to the conservation of momentum, increased velocity of air can be achieved through the outlet openings thus expelling more hot air from the channel 212.

A plurality of fins 260 extend upwardly from the upper surface 222 of the base 220 in an upstream portion of the channel 222. Air traveling through the portion of the channel 212 that includes the fins 260 generally travels at a slower speed as compared to the area near the outlet openings 238. Accordingly, more heat can be transferred because more surface area is provided in the area that includes the fins 260.

The internal wall member 234 and the outer walls 236 are appropriately shaped to constrict the channel 212 in an area between the free end of the blade 206 and the attached end of the blade. In an embodiment depicted in FIG. 5, the exterior wall 226 extends inwardly at a protuberance 262 and the internal wall member 234 also extends inwardly into the channel 212 at a protuberance 264. The protuberances 262 and 264 act as a sort of nozzle similar to the angled walls 162 described with reference to the embodiment disclosed in FIGS. 3 and 4. Accordingly, the protuberances act to urge air vortices formed in a vortex shaping zone 280 of the channel and urges the vortices out the outlets 238. To further enhance heat dissipation, in addition to the heat sink 202, the outer walls 226, the interior wall member 234, the barrier member 232 and the fins 260 can all be made from a highly thermally conductive material such as metal.

Figure 6:
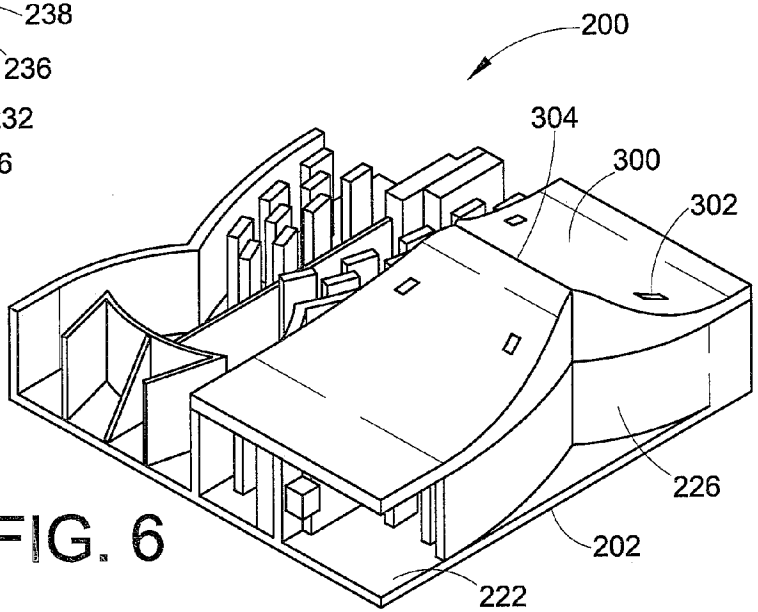
FIG. 6 is a perspective view of the electronic device of FIG. 5 including a lid.

With reference to FIG. 6, a lid 300 can attach to the walls 226 and 234 of the heat sink. In FIG. 6, the lid 300 is shown only covering half of the heat sink; this is shown for reasons for clarity. The lid 300, or lids, can cover the entire heat sink 202. The lid can also include openings 302 that can provide further inlets and outlets to the channel 212.

In the depicted embodiment, the lid is non-planar. The lid is non-planar in that it can include an apex 304 that is disposed at a distance greater from the fan blade 206 as compared to other portions throughout the lid. The apex 304 can align with the constriction that is defined by the protuberances 262 and 264 (FIG. 5). The raised area adjacent the protuberances allows for air to move upwardly (i.e., towards the lid) as the vortex is compressed against the respective wall 226 or 234. If desired, the base 220 can also take a non-planar shape that is similar to that of the lid 300.

An electronic device having enhanced dissipating features has been described with reference to the above-described embodiments. Modifications and alterations will occur to those upon reading and understanding the preceding detailed description. The invention is not limited to only the embodiments disclosed above. Instead, the invention is defined by the appended claims and the equivalents thereof.

The invention claimed is:

1. A lamp comprising:

a light emitting diode device;

a heat sink in thermal communication with the light emitting diode device;

a channel having an inlet, an outlet and a constriction disposed along the channel between the inlet and the outlet, the heat sink defining at least a portion of the channel;

a piezoelectric element;

a blade including a free end and an attached end, the blade being disposed in the channel and connected to the piezoelectric element, wherein the piezoelectric element is activated to move the blade side to side in the channel to create air vortices, the constriction in the channel and the blade cooperating with one another such that a vortex that is generated as the blade moves toward a first side of the channel is compressed against the first side of the channel and expelled towards the outlet of the channel;

wherein the outlet of the channel has a cross-sectional area Ao and the channel has a cross-sectional area A upstream from the outlet, wherein Ao<A; and wherein the channel has a cross-sectional area Ac at a narrowest point of the constriction, wherein Ao<Ac.

2. The lamp of claim 1, further comprising a baffle disposed in the channel downstream from the free end of the blade.

3. The lamp of claim 1, wherein the heat sink includes a plurality of fins disposed in an upstream area of the heat sink.

4. The lamp of claim 1, further comprising:

an additional channel having an inlet, an outlet and a constriction disposed along the additional channel between the inlet and the outlet of the additional channel, the heat sink defining at least a portion of the additional channel;

an additional piezoelectric element;

an additional blade including a free end and an attached end, the additional blade being disposed in the additional channel and connected to the additional piezoelectric element, wherein the additional piezoelectric element is activated to move the additional blade side to side in the additional channel to create air vortices, the constriction in the additional channel and the additional blade cooperating with one another such that a vortex that is generated as the additional blade moves toward a first side of the additional channel is compressed against the first side of the additional channel and expelled towards the outlet of the additional channel.

5. The lamp of claim 4, wherein the blade is positioned in the channel to generate an air flow in a first general direction and the additional blade is positioned in the additional channel to generate an air flow in a second general direction, the first general direction being substantially opposite the second general direction.

6. An assembly comprising:

an electronic device;

a heat sink in thermal communication with the electronic device, the heat sink defining a base surface;

a channel, the base surface of the heat sink at least partially defining the channel;

a fan blade disposed in the channel, wherein the fan blade has planar surfaces, is spaced from the base surface of the heat sink, and is disposed substantially perpendicular to the base surface;

a piezoelectric element attached to the fan blade, wherein the piezoelectric element is activated to cause the fan blade to oscillate and generate an airflow path in the channel in which air travels substantially in a direction from an attached end of the fan blade toward a free end of the fan blade;

a constrictive member extending into the channel between the free end of the fan blade and the attached end of the fan blade substantially towards at least one of the planar surfaces of the fan blade such that said channel is wider upstream and downstream of said constrictive member; and a baffle disposed downstream from the free end of the fan blade, the baffle extending into the channel and limiting a cross-sectional area of the channel where the baffle is located.

* * * * *